US012004698B2

(12) United States Patent
Petrone et al.

(10) Patent No.: US 12,004,698 B2
(45) Date of Patent: Jun. 11, 2024

(54) TABLEWARE HYDRO-CLEANING APPARATUS

(71) Applicant: SHABOSH S.R.L., Naples (IT)

(72) Inventors: Nicolo Petrone, Naples (IT); Raimondo Raffi, Naples (IT); Simone Peronaci, Milan (IT)

(73) Assignee: SHABOSH S.R.L., Naples (IT)

( * ) Notice: Subject to any disclaimer, the term of this patent is extended or adjusted under 35 U.S.C. 154(b) by 5 days.

(21) Appl. No.: 17/632,935

(22) PCT Filed: Aug. 6, 2020

(86) PCT No.: PCT/IB2020/057431
§ 371 (c)(1),
(2) Date: Feb. 4, 2022

(87) PCT Pub. No.: WO2021/024218
PCT Pub. Date: Feb. 11, 2021

(65) Prior Publication Data

US 2022/0287541 A1 Sep. 15, 2022

(30) Foreign Application Priority Data

Aug. 7, 2019 (IT) ..... 102019000014313

(51) Int. Cl.

| | |
|---|---|
| ***A47L 15/00*** | (2006.01) |
| ***A47L 15/42*** | (2006.01) |
| ***A47L 15/44*** | (2006.01) |
| ***A47L 15/50*** | (2006.01) |

(52) U.S. Cl.
CPC ..... *A47L 15/0089* (2013.01); *A47L 15/4223* (2013.01); *A47L 15/4225* (2013.01); *A47L 15/4274* (2013.01); *A47L 15/4278* (2013.01); *A47L 15/4418* (2013.01); *A47L 15/503* (2013.01)

(58) Field of Classification Search
CPC ..... A47L 15/0089; A47L 15/4223; A47L 15/4225; A47L 15/4274; A47L 15/4278; A47L 15/4418; A47L 15/503
See application file for complete search history.

(56) References Cited

U.S. PATENT DOCUMENTS 3,926,668 A 12/1975 Ross

FOREIGN PATENT DOCUMENTS

| | | | | |
|---|---|---|---|---|
| CN | 108378800 A | * | 8/2018 | ..... A47L 15/0089 |
| CN | 108378800 A | | 8/2018 | |
| DE | 4438279 A1 | | 5/1996 | |
| DE | 102004057019 A1 | | 6/2006 | |
| GB | 2130477 A | | 6/1984 | |
| GB | 2548067 A | | 9/2017 | |
| KR | 950007079 Y1 | * | 8/1995 | |

* cited by examiner

*Primary Examiner* — Cristi J Tate-Sims
(74) *Attorney, Agent, or Firm* — Dickinson Wright PLLC; Andrew D. Dorisio

(57) ABSTRACT

A compact counter manual use tableware hydro-cleaning apparatus (10, 10') comprising two operating units defined by a first unit (12, 12') and by a second unit (14) not rigidly connected to each other, separable, movable and positionable/repositionable independently with respect to each other, the first unit (12, 12') defining a control unit which houses the components/devices required for the operation of the hydro-cleaning apparatus and the second unit (14) defining a tableware washing chamber.

10 Claims, 7 Drawing Sheets

TABLEWARE HYDRO-CLEANING APPARATUS

TECHNICAL FIELD

The present invention relates to a tableware hydro-cleaning apparatus.

BACKGROUND

More particularly, the present invention relates to a compact counter tableware hydro-cleaning apparatus, i.e. suitable to be positioned on the dripping surface of a kitchen sink.

As is known, tableware can be washed by hand or automatically by means of hydro-cleaning household appliances more typically known as dishwashers.

The use of dishwashers has become more and more widespread over the years and these household appliances are increasingly present in homes and in facilities used for catering services or cafeterias in general; this is due to various factors such as, for example, a comfort linked to the fact that the person does not waste time and effort like when washing tableware by hand or to a lower consumption of water and/or detergents used for the washing (this based on eco-friendly practices and the like).

The hydro-cleaning apparatuses or dishwashers are of different types and sizes and they are chosen based on the washing need (load capacity intended as the number of table washable in a washing cycle) and/or based on the integration requirements, for example, in the residential space (for example, built-in dishwashers that fit into kitchen furniture structures or limited space for smaller spaces).

However, conventional dishwashers can be oversized in some situations and, therefore, can create space problems and cannot be integrated in all residential spaces and, therefore, cannot be used due to lack of space.

In addition, traditional dishwashers always require the intervention of a skilled technician who takes care of installation and testing.

In addition, the load capacities of conventional dishwashers can be excessive, for example, for a single person who—consequently and in order not to waste too much water, electric current and detergents—accumulates tableware in the dishwasher so as to run it at full load, with the drawback lying in the fact that the dirt on the tableware can become more difficult to remove or with drawbacks linked to the fact that the user does not have tableware sufficient to completely fill the household appliance.

Other drawbacks regarding conventional dishwashers lie in the fact that they require a connection to the water mains, to a drainage system and to the electric power supply; however, not all the residential solutions are designed for the installation of dishwasher; this is a major drawback, considering that in the case of restricted residential spaces (for example in bedsit or the like) it is difficult to find a compartment or space for positioning a dishwasher of the conventional type or even of the reduced space type, for example, in the kitchen cabinet it is difficult if not impossible to position the dishwasher due to the dimensions of the cabinet itself.

Compact dishwashers which do not need to be connected to the water mains and to the drainage system in a manner similar to those of conventional "large" dishwashers and which can also be arranged on a work surface of the kitchen permanently or temporarily (for example kept in compartments if not in use) have been developed with the aim of trying to overcome such drawbacks.

Some compact dishwashers are connected by means of pipes to the tap of the sink and to the drainage system thereof; however, such type of household appliance entails drawbacks linked to the fact that when the household appliance is running the user cannot use the water dispensed by the tap for other purposes and, in addition, it is necessary to adapt the tap connection or to use connecting elements in order to be able to connect said tap to the pipes of the dishwasher.

Other types of compact dishwashers comprise a liquid reservoir in the household appliance that can be detached/separated from the body of the household appliance so as to be filled with water and detergent and, subsequently, repositioned in the body of the household appliance to allow the correct operation thereof.

However, this solution also entails drawbacks linked to the need to assemble/disassemble the reservoir of the washing liquid in order to allow the filling thereof, and this, in the long run, can cause wear or breakage both of the reservoir and of the components or elements in the body of the dishwasher, which are designed to house the reservoir.

Document GB2548067 describes an apparatus dedicated to washing and cleaning tableware and, more particularly, cutlery made similar to a blender and comprising a base unit possibly provided with means for driving rotating brushes arranged in a further unit which is functional to housing the cutlery and washing water and with said further unit closed by means of a lid; this type of washing apparatus is not suitable for the washing of tableware such as plates and/or glasses.

Furthermore, it does not overcome the drawback described above and linked to the need to assemble/disassemble the reservoir of the washing liquid in order to allow the filling thereof.

SUMMARY

The object of the present invention is to overcome the aforementioned drawbacks.

More particularly, an object of the present invention is to provide a tableware hydro-cleaning apparatus that is compact in size and suitable for being positioned on the kitchen sink for example on the dripping surface of the sink and, in particular, an object of the present invention is to provide a hydro-cleaning apparatus that can be universally adapted to all kitchen solutions.

A further object of the present invention is to provide a tableware hydro-cleaning apparatus that does not require a direct connection to the water mains and to the drainage system.

A further object of the present invention is to provide a hydro-cleaning apparatus that is easy to use and easy to position while preparing for use, as well as an apparatus which facilitates the loading and unloading of the tableware and drying thereof.

A further object of the present invention is to provide a hydro-cleaning apparatus which allows to wash tableware within a short time and with a low water consumption.

A further object of the present invention is to provide a tableware hydro-cleaning apparatus which is compact and which, in any case, does not create overall dimensions-related on the sink or problems linked to vacating spaces on the sink in case of need.

A further object of the present invention is to provide the users with a tableware hydro-cleaning apparatus suitable to allow a high resistance and reliability over time and, in addition, such to be easy and cost-effective to manufacture. These and other objects are attained by the invention having the characteristics according to claim 1.

According to the invention, herein provided is a compact counter tableware hydro-cleaning apparatus comprising two operating units defined by a first unit and by a second unit not rigidly connected to each other, separable, movable and positionable/repositionable independently with respect to each other, the first unit defining a control unit which houses the components/devices required for the operation of the hydro-cleaning apparatus and the second unit defining a tableware washing chamber.

Advantageous embodiments of the invention are outlined by the dependent claims.

BRIEF DESCRIPTION OF THE DRAWINGS

The construction and functional characteristics of the tableware hydro-cleaning apparatus of the present invention will be clearer from the following detailed description in which reference is made to the attached drawings representing an embodiment thereof exclusively provided by way of non-limiting example and wherein:

FIG. 7 illustrates an axonometric view of the pressure cleaning apparatus, FIG. 8 shows an axonometric view of a component of said hydro-cleaning apparatus and FIG. 9 illustrates the hydro-cleaning apparatus according to the alternative embodiment arranged with respect to a sink.

DETAILED DESCRIPTION

Figure 1:
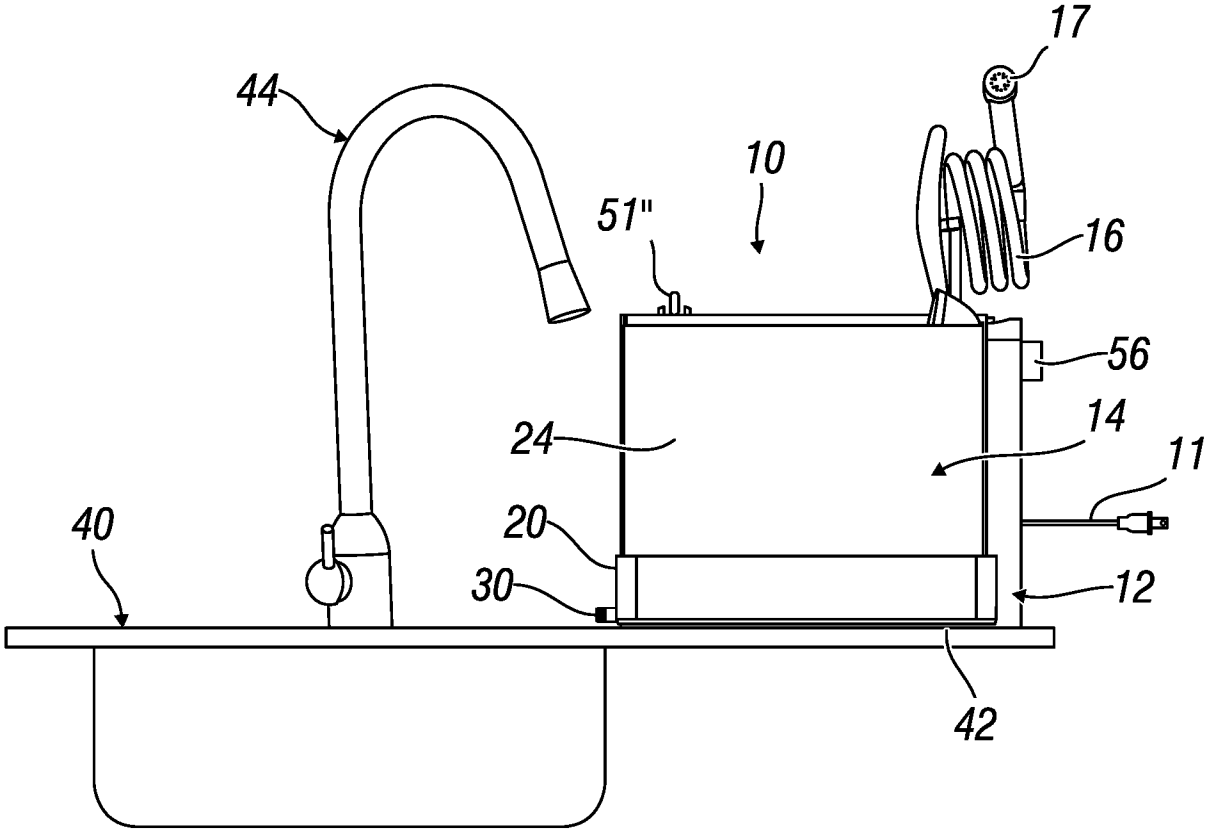
FIG. 1 represents a front view of a tableware hydro-cleaning apparatus of the present invention according to a preferred embodiment.

With reference to the aforementioned figures, the tableware hydro-cleaning apparatus of the present invention, generally indicated with the reference numeral 10 in the aforementioned figures, substantially comprises two units defined by a first unit 12 and by a second unit 14 not rigidly connected to each other, separable, movable and positionable/repositionable independently with respect to each other.

The first unit 12 defines a control unit which houses the components/devices required for the operation of the hydro-cleaning apparatus, with said components housed in single and separate compartments, said components/devices housed in said compartments and comprising a pump 13 (preferably of the diaphragm type and, preferably, a pump operating at a pressure of 3-9 Bar, a flow rate of about 4-4.5 Litres/minute and a temperature comprised between 60 and 65° C.), a transformer 15, a socket or terminal 11 for connection to the power supply mains and an on/off switch (the transformer being suitable to supply the pump 13), a duct or cannula 16 provided with a nozzle 17 (for example of the shower-head type or with a flat blade type or of another type suitable for the purpose) connected to the pump 13 for spreading a washing liquid on the tableware (as detailed hereinafter) and a container 20 comprised in the volume of the first unit 12 that is slidable and partially extractable and positionable/orientable with respect thereto (for the loading of the water and washing detergent).

The container 20 externally comprises a handle 20' (or a knob or an equivalent grip means) to allow the extraction of the container when using the hydro-cleaning apparatus and so as to allow the repositioning thereof when the apparatus is not in use.

Figure 4:
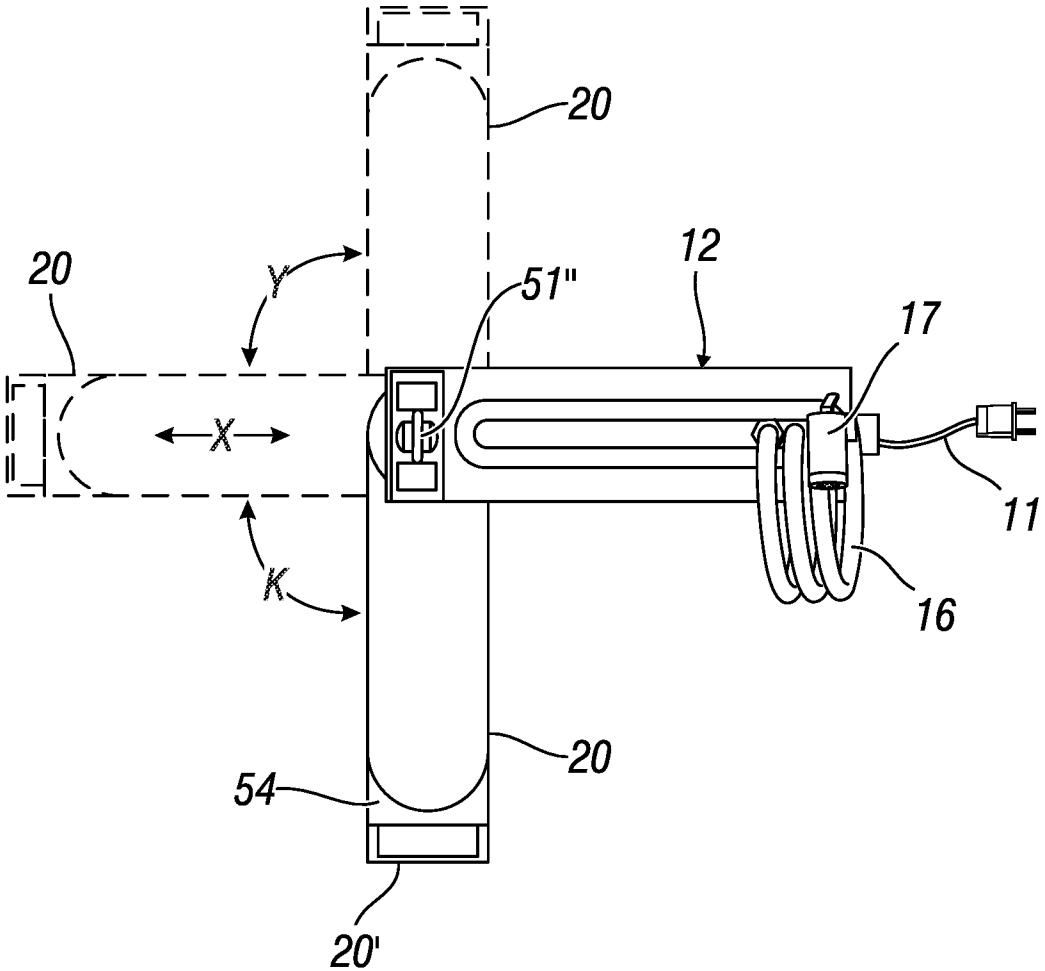
FIG. 4 schematically represents a plan view of a component of the apparatus of the invention in an operating configuration.

Said container 20 can provide for the possibility of being extracted with respect to the first unit 12 and oriented with respect thereto in order to be able to adapt to all the configurations of positioning the tap of the sink or the overall dimensions of the sink, as schematically shown in FIG. 4.

Figure 3:
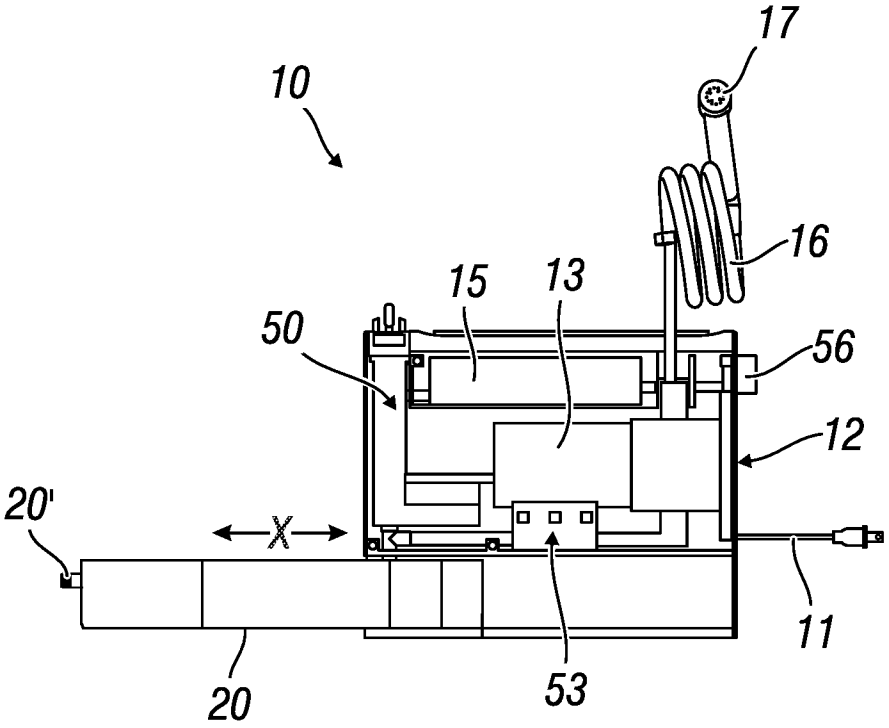
FIG. 3 schematically illustrates a partially sectioned front axonometric view of a component of the hydro-cleaning apparatus of the invention.

In this case, the container comprises a rotational constraint connection (of the hinge type or similarly known and suitable for the purpose) with respect to the first unit 12 which allows a rotation of said container with respect to the first unit 12 (according to a vertical rotation axis) once said container 20 is extracted with respect to said first unit 12; in particular, the container 20 is extracted with respect to the first unit according to a longitudinal extension direction of said container (direction indicated by the arrow "X" in FIG. 3 and FIG. 4) and, once extracted (at the end of the stroke thereof), said container 20 can be rotated by 90° with respect to the first unit, to the right or to the left, so as to be able to achieve, as a whole, a rotation by 180° (it is to be understood that the container can also be rotated and positioned in all positions included in a 180° angle, in order to be able to orient the container 20 as a function of the position of a tap 44 of a sink 40).

Figure 5:
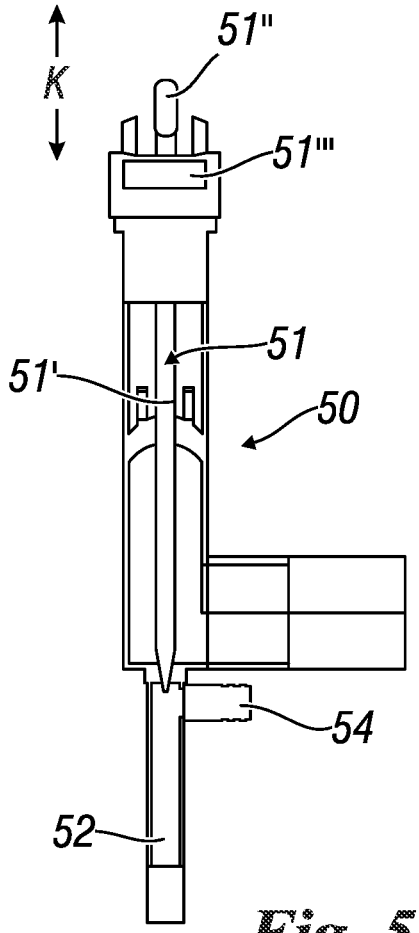
FIG. 5 schematically represents a plan view of a device in the component of FIG. 3 of the apparatus of the invention.
Figure 6:
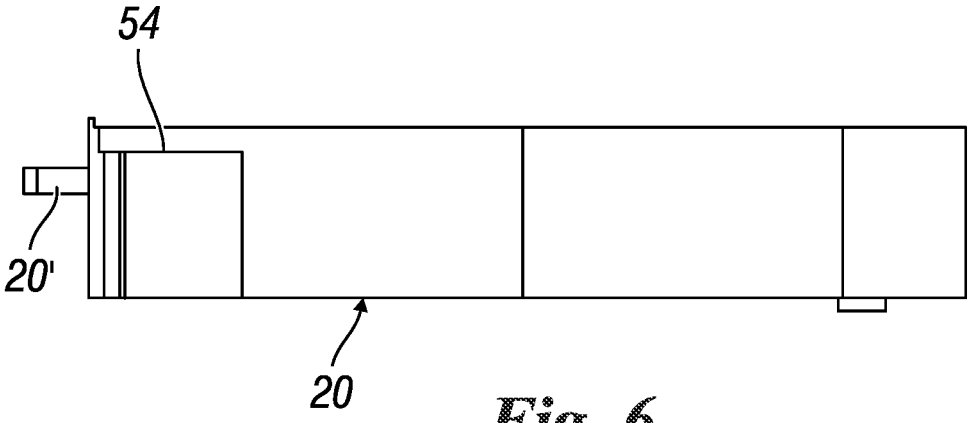
FIG. 6 schematically represents a front view of a further component of the hydro-cleaning apparatus of the invention.

Also arranged inside the first unit 12 is a means or device 50 for supplying the detergent (typically tableware liquid soap) to be mixed with the water of the container 20, with said device 50 which comprises a manually controlled valve 51 which comprises a plunger 51' comprising: in the preferred embodiment, an elastic return spring (not shown) (however, the return to the "zero" position of said plunger 51' can also be actuated manually or with a mechanism of the "interlocking" type), with said plunger 51 which, when (in the preferred embodiment shown in the figures) is pulled/moved upwards (in a vertical direction as indicated by the arrow "K" of FIG. 5), allows the descent—by gravity—of the detergent contained in a compartment 51''' which is mixed with the water of the container (water and soap mixture—as indicated by the conduit 52 of FIG. 5) and which is drawn from the pump 13 and conveyed to the duct or cannula 16 (as indicated by the conduit 54 of FIG. 5) and which—when released—returns to the initial position due the return action of the spring and so as to shut/interrupt the supply of the soap to the container 20; the actuation of said valve, as indicated previously, is of the manual type and it is carried out by means of a knob 51'' which, in the preferred embodiment of the figures, allows the gripping to manually lift said plunger.

The container 20 further comprises an "overflow" valve 54 with the function of indicating an excessive filling of the container 20 by the water coming from the tap 44.

Figure 2:
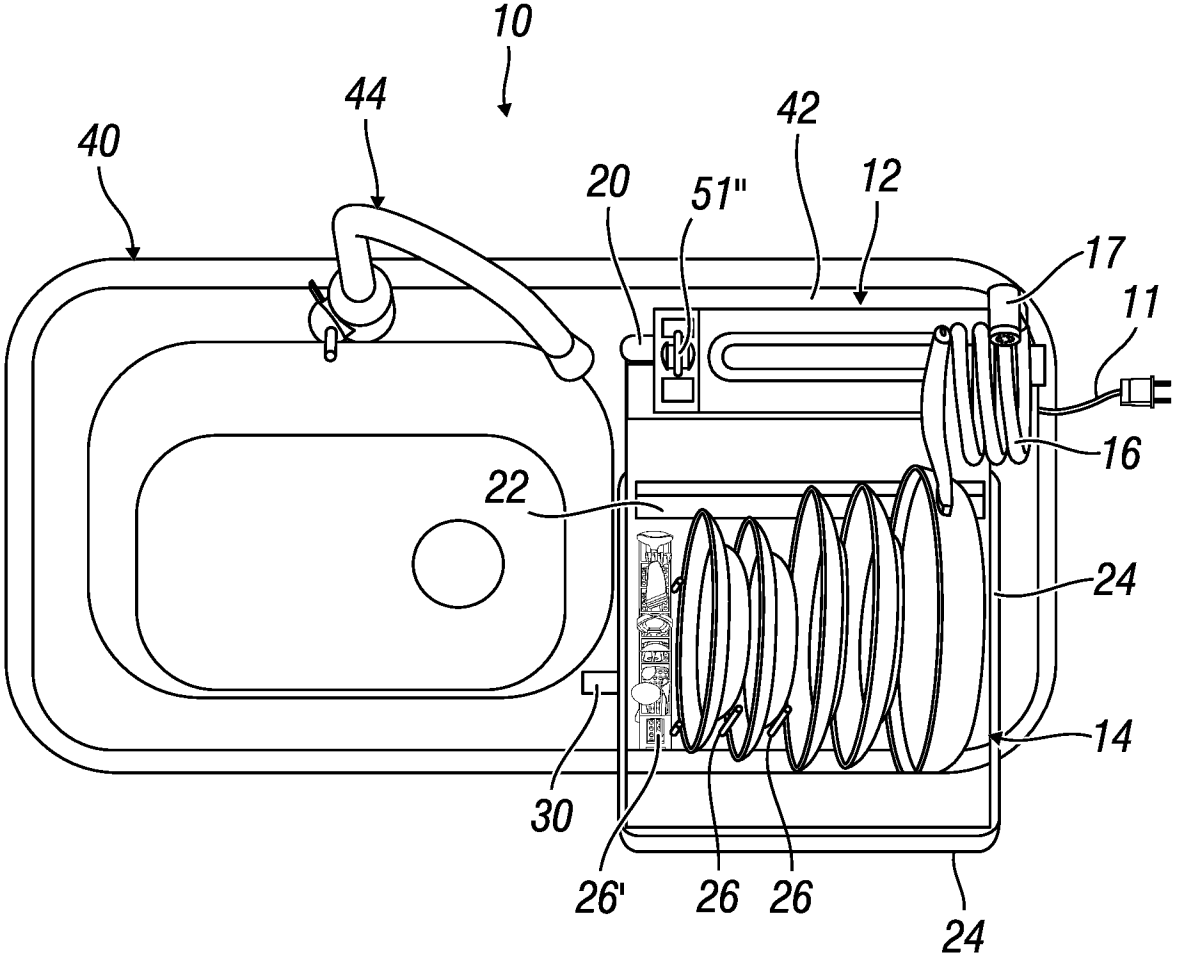
FIG. 2 schematically represents a top view of the tableware hydro-cleaning apparatus of the present invention.

According to the preferred embodiment, the functional components described above and housed in the first unit 12 are tendentially arranged according to horizontal planes parallel to each other in a configuration of the "tower" type, in order to reduce the overall dimensions of the aforementioned first unit 12, with said first unit 12 which, as schematically shown in FIG. 2, is arranged beside and adjacent to the second unit 14.

Figure 7:
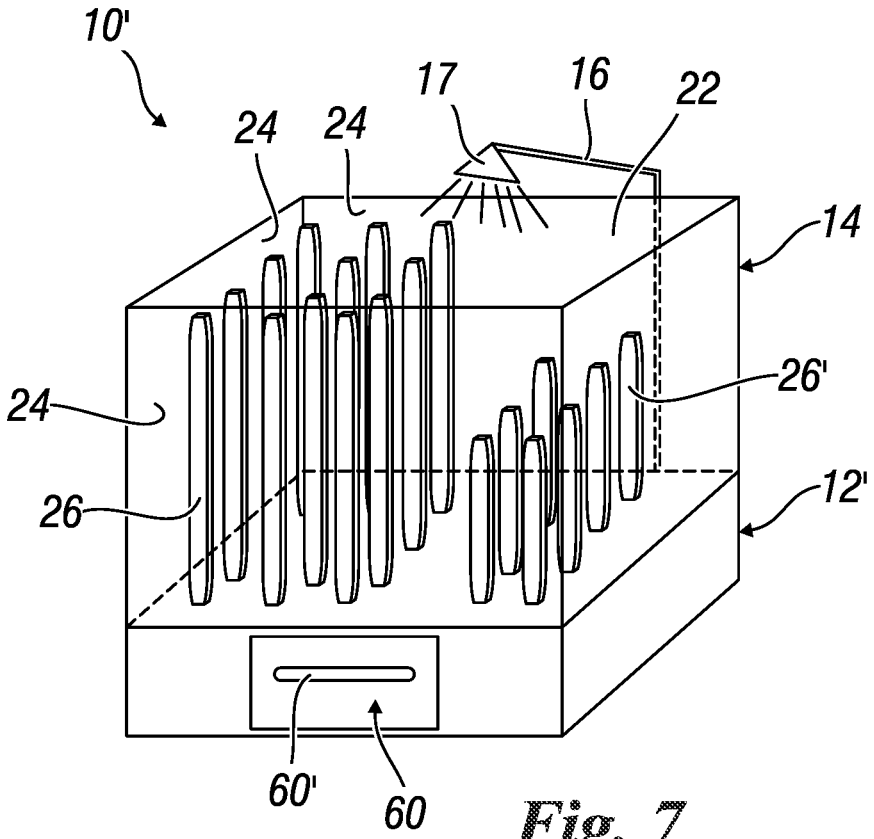
FIGS. 7 to 9 schematically illustrate the hydro-cleaning apparatus of the present invention according to an alternative embodiment and, in particular.
Figure 8:
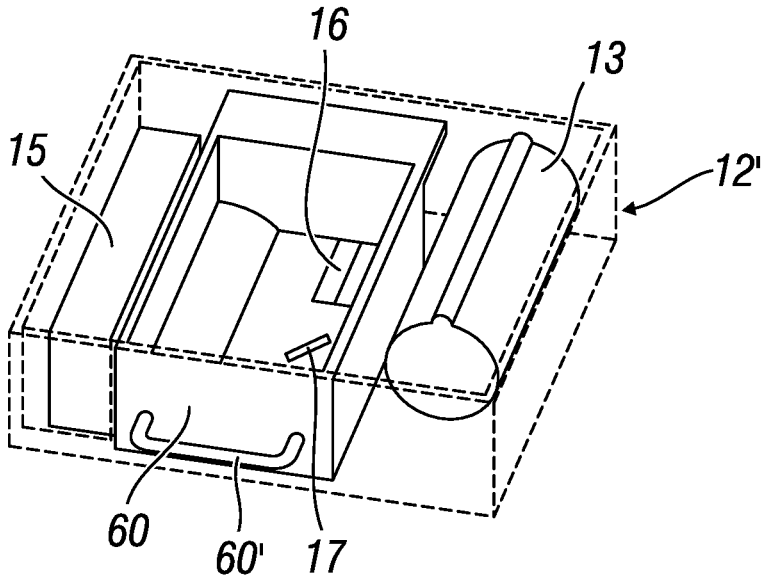
Figure 9:
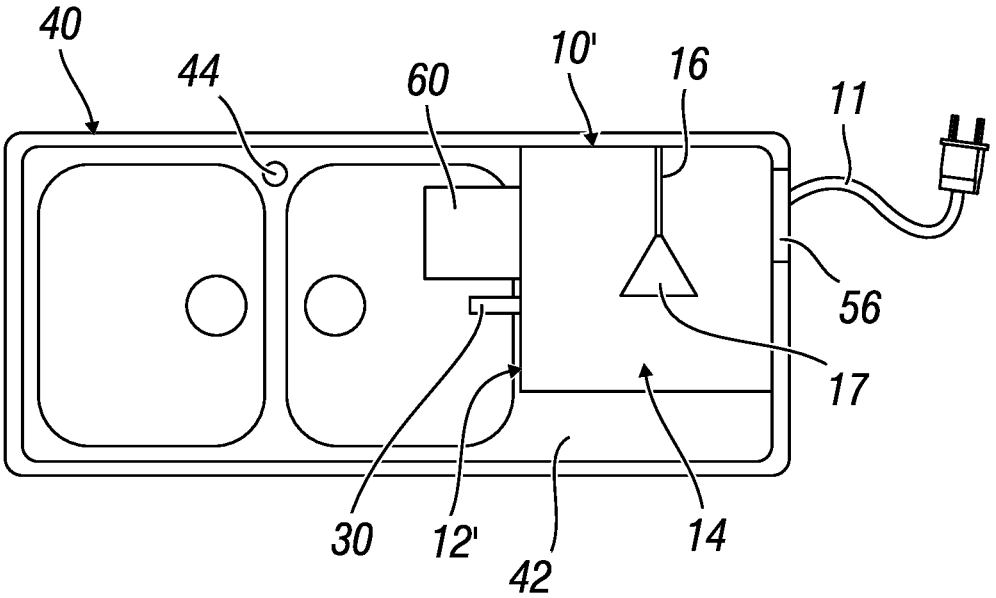

FIGS. 7 to 9 illustrate an alternative embodiment of the hydro-cleaning apparatus of the invention, indicated in its entirety with 10' and in which the details shared with the aforementioned preferred embodiment (FIGS. 1 to 6) are indicated using the same numerical reference.

The first unit 12' houses the components/devices required for the operation of the hydro-cleaning apparatus housed in single and separate compartments and, as in the aforementioned case, these components consist of a pump 13 (similar to the one described with reference to the preferred embodiment), a transformer 15, a socket or terminal 11 for connection to the power supply mains and an on/off switch, a duct or cannula 16 provided with a nozzle 17 (for example of the shower head type or with a flat blade or of another type suitable for the purpose) connected to the pump 13 for spreading a washing liquid on the tableware (as detailed hereinafter) and a container 60 comprised in the volume of the first unit 12' that is slidable and partially extractable by means of a handle or gripping element 60' and positionable/orientable with respect to said first unit in a manner similar to the one described above with reference to the preferred embodiment (therefore, it is not described in further detail.)

According to the alternative embodiment, the means or device 50 for supplying the washing detergent has the same characteristics as in the preferred embodiment, with the difference lying in the fact that it is housed differently in the first unit 12' and, more particularly, it differs from the manual actuation of the plunger 51 which, tendentially, will move according to a horizontal axis.

According to such embodiment, the components inside the first unit 12' are arranged according to a substantially horizontal plane.

The second unit 14 defines the tableware washing chamber which is completely similar to the second unit according to the preferred embodiment described with reference to FIGS. 1 to 6 and it is therefore not the subject of further description.

With reference to the alternative embodiment, the first unit 12' is configured to define a support base for the second unit which is positioned above said first unit 12', as schematically shown in FIG. 7.

FIGS. 1 and 2 schematically illustrate the tableware hydro-cleaning apparatus of the present invention when arranged on a conventional kitchen sink 40 or the like.

In particular, FIGS. 1 and 2 illustrate hydro-cleaning apparatus comprising the first unit 12 with a tower-like configuration, with the second unit 14 arranged adjacent to said first unit 12.

FIG. 9 illustrates the tableware hydro-cleaning apparatus of the present invention, according to the alternative embodiment, when arranged on a conventional kitchen sink 40 or the like.

The hydro-cleaning apparatus, when in use for washing tableware arranged in the washing compartment 22 of the second unit 14, is arranged on a dripping surface 42 of the sink 40 with the cannula 16 provided with the nozzle 17 which is positioned in correspondence with the second unit 14 with the nozzle 17 arranged above the washing compartment 22 and with the container 20 and the drain valve 30 arranged in an position for the outflow, respectively, from the first unit 12 and from the second unit 14.

Once extracted with respect to the first unit 12 (12'), the container 20 (or 60) is oriented as a function of the position of the tap 44 of the sink 40.

For washing the tableware, the hydro-cleaning apparatus is connected to the power supply mains, the container 20 (60) is filled with water coming from a tap 44 of the sink 40 and the manual valve is actuated for the outflow of the detergent from the dedicated reservoir and, once the operation of the first unit 12 (12') has been activated by means of the on/off switch 56, the user manually orients the washing nozzle 17 to facilitate an accurate cleaning of the dishes in the washing compartment 22.

Once the washing operation has been completed, the first unit 12 (12') is switched off by means of the on/off switch with the waste water which is expelled through the drain valve 30. During the tableware washing step, the tap remains open to maintain an adequate and sufficient level of water in the container 20 (60); however, according to an alternative embodiment, the container 20 (60) is dimensioned according to the sufficient amount of water to carry out a complete washing and, in this case, the container is filled and then the tap is subsequently shut.

Once the washing has been completed and when the hydro-cleaning apparatus is not in use, it can be displaced and kept in a place at will, thus vacating the space on the sink.

The washing operation by means of the hydro-cleaning apparatus of the invention requires about 60 to 120 seconds with a consumption (from experimental tests conducted) comprised between about 4 and 8 litres; tests conducted found that the washing time is about 1-2 min with a water consumption of less than 5 L per minute.

The advantages attained by the hydro-cleaning apparatus of the present invention are observable in the light of the above.

The tableware hydro-cleaning apparatus of the present invention has the advantage of being compact and small in size and the two units it consists of, separate with respect to each other and positionable and repositionable, allow an easy adaptability of the apparatus to sinks of different types and sizes.

Further advantageous is the fact that the two units (first unit and second unit) that the hydro-cleaning apparatus consists of, being separate from each other, allow to reduce space even when the hydro-cleaning apparatus is not in use.

A further advantage of the hydro-cleaning apparatus of the invention lies in the fact that being separate from the first unit, the second unit (which defines the washing chamber) can be easily washed (to eliminate any stains or lime residues that can be formed after several washing cycles). In addition, it is easy to dry so it can be repositioned when not in use.

Further advantageous is the fact that in case of malfunction or failure even just one of the two units can be replaced, with an ensuing saving in terms of costs.

A further advantage lies in the fact that the hydro-cleaning apparatus of the invention allows to carry out a complete washing in short times ranging from 1 to 2 minutes with a very low water consumption and less than 5 litres per minute.

Though the invention has been described above with reference to the embodiments thereof provided solely by way of non-limiting example, numerous modifications and variants shall be clear to a man skilled in the art in the light of the description above. Thus, the present invention protects all modifications and variants that fall within the scope of protection of the claims that follow.

The invention claimed is:

1. A compact counter manual use tableware hydro-cleaning apparatus (10, 10'), characterised in that it comprises two operating units defined by a first unit (12, 12') and by a second unit (14) not rigidly connected to each other, separable, movable and positionable/repositionable independently with respect to each other, the first unit (12, 12') defining a control unit which houses the components/devices required for the operation of the hydro-cleaning apparatus and comprising single compartments separated from each other for housing a pump (13), a transformer (15) with relative output port for connection to the power supply by means of a socket or terminal (11), a duct or cannula (16) provided with a nozzle (17) and connected to the pump (13), said first unit further comprising a container (20, 60) defining a reservoir for the washing water and the second unit (14) defining a tableware washing chamber comprising support elements (26, 26') of equal or different heights and with a distribution functional to the positioning of the tableware, the first unit (12, 12') comprises a means or device (50) for supplying washing detergent to be mixed with the water of the container (20), with said device (50) comprising a manually controlled valve (51) comprising a plunger (51') provided with an elastic return spring, said plunger (51) which, when pulled/moved, allows a descent—by gravity of the detergent contained in a compartment (51''') which is mixed with the water of the container (20, 60) to be drawn by the pump (13) and conveyed to the duct or cannula (16) and which, when released, returns to the initial position due to the return action of the spring and shuts the supply of the soap to the container (20, 60), the actuation of said valve being of the manual type by means of a knob (51'').

2. The hydro-cleaning apparatus according to claim 1, characterised in that the first unit (12, 12') comprises an on/off switch (56) for the hydro-cleaning apparatus.

3. The hydro-cleaning apparatus according to claim 1, characterised in that the container (20, 60) comprises an "overflow" valve.

4. The apparatus according to claim 1, characterised in that the container (20, 60) comprises a rotational constraint connection according to a vertical rotation axis with respect to the first unit (12, 12') in order to be oriented in a horizontal plane and according to a vertical axis in an angular range comprised between 0° and 180° once it has been extracted with respect to said first unit (12, 12') as a function of the position of a tap (44) of a sink (40).

5. The apparatus according to claim 1, characterised in that the support elements (26, 26') can be repositioned or folded as a function of the type of tableware to be washed and/or the number of said tableware.

6. The apparatus according to claim 1, characterised in that the second unit (14) comprises a washing compartment (22) open at the top and perimetrically delimited by walls (24).

7. The apparatus according to claim 6, characterised in that the second unit (14) comprises a discharge drain valve (30) of the extractable or retractable type with respect to the structure of the second unit (14).

8. The apparatus according to claim 1, characterised in that, in use, it is arranged on a sink (40) of a kitchen with the first unit (12) and the second unit (14) arranged on a dripping surface (42) of the sink (40) and with said first and second units arranged adjacent to each other and side by side.

9. The apparatus according to claim 1, characterised in that, in use, it can be is arranged on a sink (40) of a kitchen with the first unit (12') at contact with a dripping surface (42) of said sink (40) and with the second unit (14) arranged above said first unit (12').

10. Use of the hydro-cleaning apparatus according to claim 1, characterised in that it comprises the steps of:

- positioning the hydro-cleaning apparatus on a dripping surface (42) of a sink (40) or on a surface at a sink;
- connecting the apparatus to the power supply mains;
- partially extracting the container (20, 60) with respect to the body of the first unit (12, 12') and possible angular orientation thereof as a function of the position of the tap (44) of the sink (40), filling of the container (20, 60) and operating the manual valve (51) for the detergent to flow out from the dedicated reservoir;
- actuating the operation of the first unit (12, 12') by means of the on/off switch (56);
- manually washing the dishes arranged in the washing compartment (22) of the second unit (14) by means of the nozzle (17) connected to the first unit (12, 12') by means of the cannula (16);
- terminating the washing step by switching off the apparatus and ejecting the waste water through the drain valve (30).

* * * * *